United States Patent [19]

Izawa et al.

[11] 4,091,545

[45] May 30, 1978

[54] METHOD FOR REMOVING WATER AND GREASE DEPOSIT FROM ROLLING MILL SLUDGE

[75] Inventors: Tetsuo Izawa, Yokohama; Shuji Kajikawa, Zushi; Koji Satomi, Tokyo; Koichiro Nakano, Yokohama; Shinichi Kurosawa, Kawasaki; Keitaro Hirai, Yokohama; Yuichi Tsukada, Tokyo, all of Japan

[73] Assignee: Nippon Kokan Kabushiki Kaisha, Tokyo, Japan

[21] Appl. No.: 813,808

[22] Filed: Jul. 8, 1977

Related U.S. Application Data

[63] Continuation of Ser. No. 662,617, Mar. 1, 1976, abandoned.

[30] Foreign Application Priority Data

Mar. 8, 1975 Japan ..... 50-27628

[51] Int. Cl.[2] ..... F26B 3/18

[52] U.S. Cl. ..... 34/9; 209/11; 210/67; 210/71; 210/75; 210/77; 210/79

[58] Field of Search ..... 210/65-69, 210/70, 71, 75-77, 79, 152, 153, 160, 175, 180, 184, 185, 193, 198 R, 209, 216, 359, 400, 401, 526; 209/11; 75/3, 5, 44 S; 264/11; 23/313; 34/9, 95; 110/15; 159/1 RW

[56] References Cited

U.S. PATENT DOCUMENTS 3,870,632 3/1975 Erskine ..... 210/71

*Primary Examiner*—Frank Sever

*Attorney, Agent, or Firm*—Flynn & Frishauf

[57] ABSTRACT

For the purpose of utilizing as a sinter raw material a rolling mill sludge with a grease deposit having a high moisture content, which is deposited in a waste water pit of a steel rolling mill, the moisture content of said rolling mill sludge is reduced to from about 1% to 10% by drying said rolling mill sludge at a temperature of from about 120° C to about 200° C, preferably of about 140° C to about 150° C, with the use of the waste heat of a sinter cooler of a sintering machine, or by mixing said rolling mill sludge with a mill scale of a low moisture content collected without the use of roll cooling water; and then, said rolling mill sludge, the moisture content of which has thus been reduced, is continuously fed, by cutting into substantially equal batches, to at least one of a sinter discharge section, an entry section of said sinter cooler, belt-conveyor for fines return provided adjacent to a hot screen, and a return hopper of said sintering machine; whereby said grease deposit is substantially completely removed through combustion or evaporation with the use of the heat of the sinter produced by said sintering machine.

7 Claims, 3 Drawing Figures

METHOD FOR REMOVING WATER AND GREASE DEPOSIT FROM ROLLING MILL SLUDGE

This is a continuation, of application Ser. No. 662,617, filed Mar. 1, 1976, now abandoned.

Field of the Invention

The present invention relates to a method for removing the moisture and the grease deposit from a rolling mill sludge, with a view to utilizing the treated sludge as a sinter raw material. A rolling mill sludge containing a grease deposit and having a high moisture (water) content is deposited in a waste water pit of a steel rolling mill.

BACKGROUND OF THE INVENTION

A scale or a cutting scrap in a small quantity is conventionally mixed with iron ore fines to serve as a sinter raw material. Along with the recent drastic increase in pig iron production, there is a rapidly increasing demand for sinter as an iron-making raw material, thus requiring installation of large-scale sintering machines. The resultant increase in the consumption of iron sources other than iron ore is leading to the utilization of scales and cutting scraps having a high content of grease deposit in larger quantities. From the point of view of pollution control, on the other hand, it is now a general practice to use an electrostatic precipitator for collecting the dust contained in the exhaust gas from a sintering machine.

More specifically, as shown in FIG. 1, a raw sinter mix is fed from a raw material feeder 4 into a pallet 1 driven by sprocket wheels 2, ignited by an ignition furnace 3, and then, sintered while sucking the exhaust gas through a wind box 5 and a duct 6. The dust contained in said exhaust gas in a large quantity is collected by an electrostatic precipitator 7, and said exhaust gas thus cleaned is discharged through a blower 8.

In this practice, however, if a sinter raw material containing a grease deposit such as a scale or a cutting scrap is mixed in a large quantity into said raw sinter mix, the combustion of said raw sinter mix from its upper portion on the pallet 1 by the ignition furnace 3 would raise the temperature of the middle and the lower portions thereof and cause evaporation of the deposited grease, and the grease vapor would be directed, together with the exhaust gas, into the electrostatic precipitator 7 through the wind box 5 and the duct 6. The dust collected in the electrostatic precipitator 7 has therefore a grease content of from about 0.1% to about 10%. This grease, if deposited in a large quantity on the electrodes of the electrostatic precipitator 7, would be burnt by the spark between the electrodes or by the high temperature exhaust gas, and cause troubles such as a fire in the electrostatic precipitator 7.

Because a rolling mill sludge deposited in a waste water pit of a steel rolling mill has a moisture (water) content of from about 20% to about 30% and a grease content of about 2% to about 3% even after dehydration through a filter press, the following measures are taken for the treatment thereof:

(1) To use said rolling mill sludge for reclamation or to dump the same for ocean disposal;

(2) To utilize said rolling mill sludge as an iron source after removing the grease deposit thereof by a chemical washing (i.e., washing with a chemical);

(3) To utilize said rolling mill sludge as an iron source after removing the grease deposit thereof by combustion.

However, in view of the Fe content of from about 60% to about 70% of said rolling mill sludge, method (1) above is not preferable from the standpoint of the effective use of iron resources. Furthermore, the increasing requirement for pollution control is more and more restricting places for reclamation or dumping of the same, and the disposal of rolling mill scale by this method will be impossible in the near future.

Because of the small particle diameters and the high moisture content of from about 20% to about 30%, even after the dehydration through a filter press, said rolling mill sludge has a high viscosity. Treatment of the rolling mill sludge by method (2) or (3) above, therefore, is not easy. In method (2) above, furthermore, the very difficult separation of the grease limits the use of this method.

Method (3) above requires high equipment costs for a fluidized bed furnace, a rotary kiln, a multi-stage combustion furnace and other facilities, and high operation costs. In any of these furnaces, the treatment of said rolling mill scale at a high temperature of from about 700° to about 800° C causes agglomeration of the rolling mill sludge, thus forming another disadvantage of this method. There are many other problems in this method, such as the necessity to install an electrostatic precipitator for collecting the dust contained in the combustion waste gas.

For these reasons, no satisfactory results are being obtained by any of methods (1) to (3) described above.

SUMMARY OF THE INVENTION

An object of the present invention is therefore to provide a method for effectively utilizing as a sinter raw material a rolling mill sludge containing a grease deposit and having moisture content. This sludge is deposited in a waste water pit of a steel rolling mill.

A principal object of the present invention is to provide a method for substantially completely removing the moisture and the grease deposit of said rolling mill sludge very easily and with low equipment and operation costs, with the use of the heat of the sinter produced by a sintering machine.

In accordance with one of the features of the present invention, there is provided a method for removing the moisture and the grease deposit from a rolling mill sludge, which comprises:

reducing to from about 1% to about 10% the moisture content of a rolling mill sludge containing a grease deposit and having a high moisture content, said sludge being, deposited in a waste water pit of a steel rolling mill, by drying said rolling mill sludge at a temperature of from about 120° to about 200° C, preferably of from about 140° to about 150° C, with the use of the waste heat of a sinter cooler of a sintering machine, or by mixing said rolling mill sludge with a mill scale of a low moisture content collected without the use of roll cooling water; and then continuously feeding said rolling mill sludge, the moisture content of which has thus been reduced, in substantially equal batches and feeding said batches to at least one of a sinter discharge section, an entry section of said sinter cooler, a belt-conveyor for fines return provided adjacent to a hot screen, and a return hopper of said sintering machine; thereby substantially completely removing said grease deposit through combustion or evaporation with the use of the heat of the sinter produced by said sintering machine.

BRIEF DESCRIPTION OF THE DRAWINGS

The present invention is illustrated by way of examples in the accompanying drawings which form part of this application and in which.

DETAILED DESCRIPTION OF PREFERRED EMBODIMENTS

Now, the present invention is described with reference to the drawings by way of embodiments.

EXAMPLE 1

Figure 1:
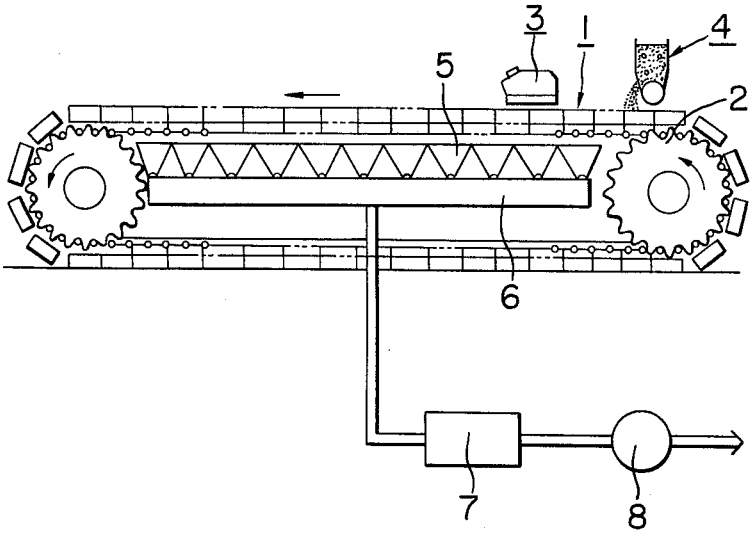
FIG. 1 is a partial side elevation schematically illustrating a conventional sintering practice of a raw sinter mix by a sintering machine.
Figure 2:
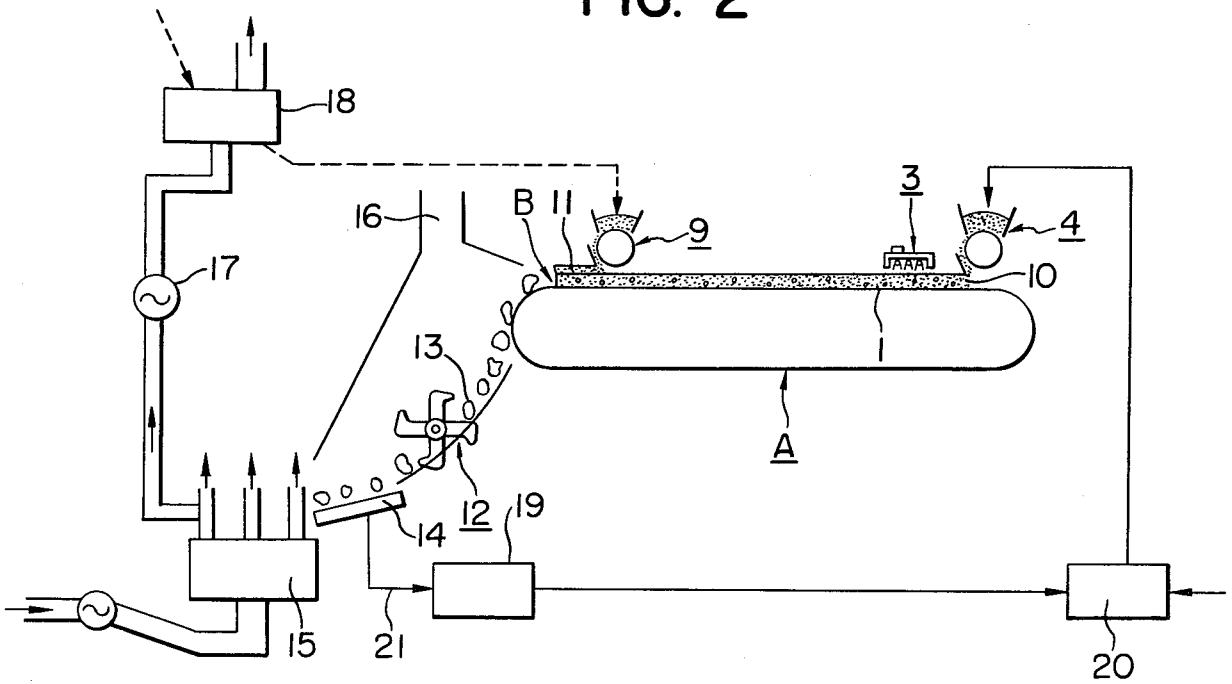
FIG. 2 is a partial side elevation schematically illustrating an embodiment of the present invention.

FIG. 2 is a partial side elevation schematically illustrating an embodiment of the present invention. As shown in FIG. 2, a raw sinter mix 10 having a known conventional composition, fed from a raw material feeder 4 onto a pallet 1 of a sintering machine A is ignited by an ignition furnace 3 and sintered as it travels to the left in the figure. A sludge feeder 9 provided at a sinter discharge section B of said sintering machine A feeds a dried rolling mill sludge 11, the moisture content of which has been reduced as described below, and which contains a grease deposit, in substantially equal batches, and feeds the batches onto the sinter on pallet 1. Said dried rolling mill sludge 11 fed onto the sinter on pallet 1 is heated by the heat of the sinter 13 while it travels to a hot screen 14 through a sinter breaker 12, and the grease deposit is substantially completely removed through combustion or evaporation. Said rolling mill sludge 11, the grease deposit of which has thus been removed, is sieved through the hot screen 14, and is sent, together with the under-screen return fines, to a return hopper 19 through a belt-conveyor for fines return 21 for temporary storage. The portion of the sinter remaining on the screen 14 is sent to a sinter cooler 15, where it is cooled.

On the other hand, part of the cooling gas (air) heated by heat exchange with the sinter at said sinter cooler 15 is directed by a blower 17 to a sludge dryer 18 (for example, a fluidized bed dryer), where said hot gas dries a rolling mill sludge charged therein. The sludge which contains a grease deposit and which has a high moisture content is one which is deposited in a waste water pit of a steel rolling mill. For example, in the case where a rolling mill sludge containing 28.0% moisture and 2.0% grease, charged into said dryer 18, was dried at a drying temperature of 140° to 150° C for 15 minutes to 20 minutes, a dried rolling mill sludge containing 1.13% moisture and 2.5% grease was obtained. A drying temperature of said rolling mill sludge exceeding 200° C in said dryer 18 causes evaporation of the grease deposit, and this requires installation of equipment to collect the grease vapor thus produced in said dryer 18. If said drying temperature is under 120° C, drying of the rolling mill sludge would take too much time. Test results reveal that said drying temperature should be from about 120° to about 200° C, preferably about 140° to about 150° C. In the present invention, therefore, the rolling mill sludge is dried with the use of the gas fraction having a temperature of about 120° to about 200° C, preferably of from about 140° to about 150° C, of the cooling gas heated by the heat exchange. It is desirable to reduce the viscosity of the rolling mill sludge by drying said rolling mill sludge to a moisture (water) content not exceeding 10%, thereby ensuring a smooth supply of the rolling mill sludge by said sludge feeder 9; however, it is not necessary to reduce the moisture content to under 1%. The rolling mill sludge 11 thus dried but still containing a grease deposit is fed by the sludge feeder 9 onto the sinter as described above to remove the grease deposit thereof.

The exhaust gas containing dust, grease combustion gas and grease vapor generated in the process between the sinter discharge section B and the hot screen 14, is collected through a hood 16, sent to a wet dust collector (not shown) where it is cleaned, and then discharged. The dehydrated and degreased rolling mill sludge and return fines sent from the return hopper 19 and the sinter raw materials sent from a raw material hooper (not shown) are mixed into a known conventional composition by a mixer 20, and fed to the raw material feeder 4 in the form of pellets produced by a pelletizer (not shown) as required.

Figure 3:
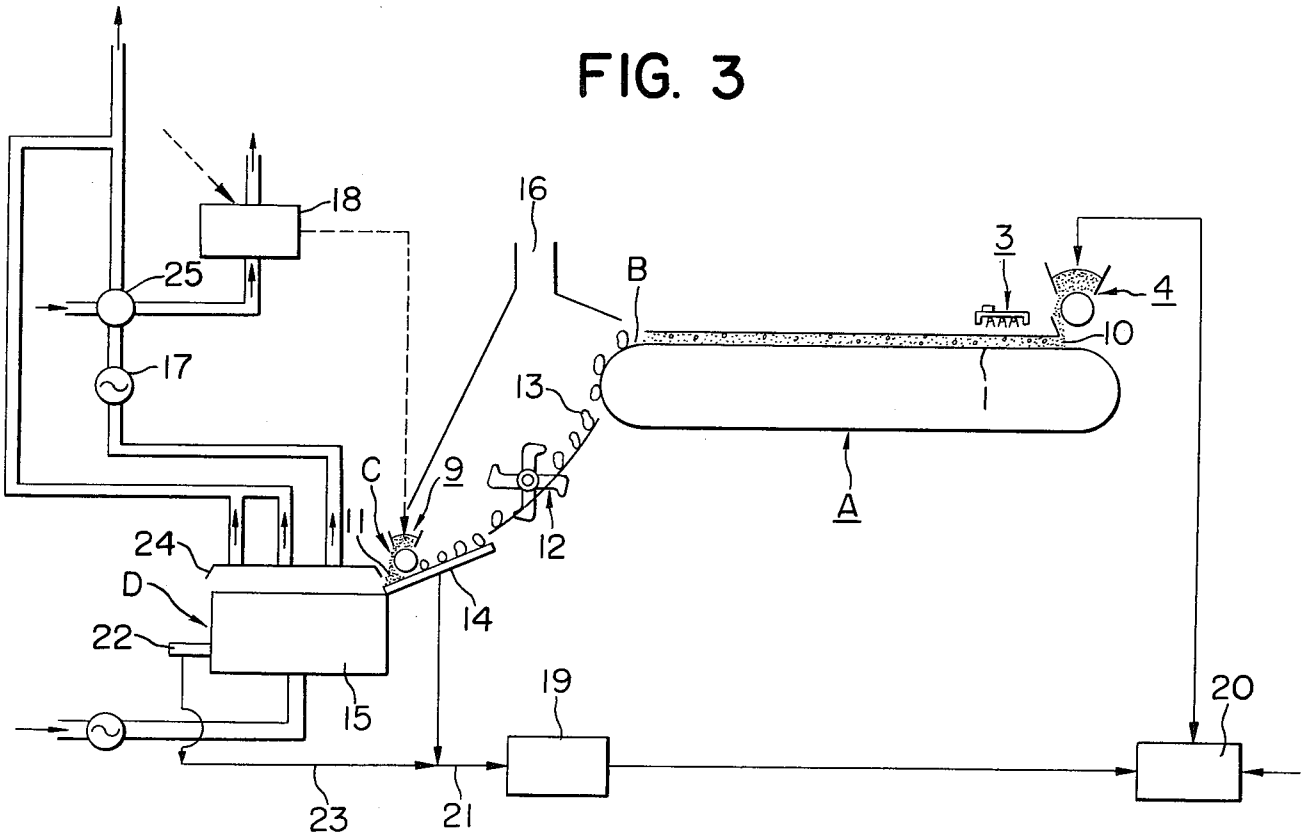
FIG. 3 is another partial side elevation schematically illustrating another embodiment of the present invention.

The aforementioned embodiment covers the case with the sludge feeder 9 installed at the sinter discharge section B. It is also possible, by installing the sludge feeder 9 at an entry section C of the sinter cooler 15 as shown in FIG. 3, to continuously feed said dried rolling mill sludge 11 containing a grease deposit in substantially equal batches to said entry section C of the sinter cooler 15, and thus to utilize the heat of the sinter in said sinter cooler 15. In this case, the grease deposit of said dried rolling mill sludge 11 is removed by evaporation while the sinter is cooled in said cooler 15. The exhaust gas containing the grease vapor produced in said cooler 15 is collected by a hood 24 and sent to a wet dust collector (not shown) where it is cleaned and then discharged. In this embodiment, part of the cooling gas (air) heated by the heat exchange with the sinter in said cooler 15, if directly brought into the sludge dryer 18, contaminates the rolling mill sludge in said dryer 18 with the grease vapor. It is therefore desirable to dry the rolling mill sludge in said dryer 18 with the use of another hot gas (air) after heat exchange with the hot gas from said cooler 15 by installing a heat exchanger 25. The rolling mill sludge, the grease deposit of which has thus been removed, is separated from the cooled sinter by a sieving equipment 22 provided at the exit section D of said cooler 15, and sent to the return hopper 19 through a belt-conveyor for fines return 23. Explanation of the other reference numerals in FIG. 3, being the same as in FIG. 2, is omitted here.

It is also possible to use said dried rolling mill sludge containing a grease deposit, by dividing it into substantially equal batches, and feeding the batches onto the belt-conveyor for fines return 21 provided adjacent to the hot screen 14 or into the return hopper 19, shown in FIG. 2, and thus remove the grease deposit of said dried rolling mill sludge through evaporation with the use of the heat of the fines return. In this case, the grease vapor produced on said belt-conveyor 21 or in said return hopper 19 is collected by employing the above-mentioned means.

EXAMPLE 2

A scale mixer (not shown) was provided in place of the sludge dryer 18 in Example 1. A rolling mill sludge containing from about 20% to about 30% moisture and having a grease deposit, and a mill scale containing not more than 6% moisture and collected without the use of roll cooling water were charged into said scale mixer at a ratio of about 1:3 and mixed up for from about 2 minutes to about 3 minutes. A mixture containing from about 7% to about 10% moisture was thus obtained. As in embodiments in Example 1 described above with reference to FIGS. 2 and 3, this mixture was fed to any of the sinter discharge section B, the entry section C of the sinter cooler 15, a belt-conveyor for fines return 21 provided adjacent to the hot screen 14 and a return hopper 19, and the grease deposit of said mixture was removed through combustion or evaporation with the use of the heat of the sinter or the fines return. In this embodiment, a mill scale containing not more than 6% moisture was mixed, because the use of a mill scale containing more than 6% moisture requires a large quantity of mill scale to reduce the moisture content of the mixture to under 10%. Detailed description is omitted here because the process in Example 2 is identical with that in Example 1 except only for the replacement of the sludge dryer 18 in Example 1 by a scale mixer.

According to the present invention, as described in detail above, it is possible to substantially completely remove the moisture and the grease deposit from a relatively fine and very viscous rolling mill sludge containing a grease deposit and having a high moisture content through very simple treatment and with very low equipment and operation costs. This permits utilization of said rolling mill sludge in a large quantity as a sinter raw material as well as prevention of fire accidents in an electrostatic precipitator caused by the grease deposit of the rolling mill sludge.

What is claimed is:

1. A method for removing water and a grease deposit from a rolling mill sludge to convert said sludge into a sinter raw material, said sludge having a water content of at least about 20 percent by weight, which comprises the sequence of steps of:

heating said rolling mill sludge with waste heat of a sinter cooler at a temperature of from about 120° to about 200° C. for a period of time sufficient to reduce the water content of said sludge to from about 1 to about 10 percent by weight, thereby reducing the viscosity thereof so as to ensure a smooth supply of said sludge; and feeding said water-reduced sludge onto hot sinter at at least one sintering operation stage consisting of (i) a sinter discharge section, (ii) an entry section of a sinter cooler, (iii) a belt conveyor for fines return provided adjacent a hot screen therein, and (iv) a return hopper of a sintering apparatus for said operation, heat of the sinter produced in said operation substantially completely removing the water and the grease deposit of said sludge.

2. The method of claim 1, wherein the rolling mill sludge is a deposit in a waste water pit of a steel rolling mill.

3. The method of claim 1, wherein said rolling mill sludge is so heated at a temperature of from about 140° to about 150° C.

4. The method of claim 1, wherein said rolling mill sludge has a water content of from about 20 to about 30 percent and a grease content of from about 2 to about 3 percent.

5. A method for removing water and a grease deposit from a rolling mill sludge to convert said sludge into a sinter raw material, said sludge having a water content of at least about 20 percent by weight, which comprises the sequence of steps of:

mixing said rolling mill sludge and a mill scale having a water content of up to 6 percent by weight to reduce the water content of said sludge to from about 1 to about 10 percent by weight, thereby reducing the viscosity of said sludge so as to ensure a smooth supply of said sludge; and feeding said water-reduced sludge onto hot sinter at at least one sintering operation stage consisting of (i) a sinter discharge section, (ii) an entry section of a sinter cooler, (iii) a belt conveyor for fines return provided adjacent a hot screen therein, and (iv) a return hopper of a sintering apparatus for said operation, heat of the sinter produced in said operation substantially completely removing the water and the grease deposit of said sludge.

6. The method of claim 5, wherein the rolling mill sludge is a deposit in a waste water pit of a steel rolling mill.

7. The method of claim 5, wherein said rolling mill sludge has a water content of from about 20 to about 30 percent and a grease content of from about 2 to about 3 percent.

* * * * *